US006544145B2

(12) United States Patent
Yoshida et al.

(10) Patent No.: US 6,544,145 B2
(45) Date of Patent: Apr. 8, 2003

(54) MOVABLE ARTIFICIAL WALL AND FREE-CLIMBING APPARATUS

(75) Inventors: Minoru Yoshida, Tokyo (JP); Kazuyuki Shiomi, Hannou (JP); Seiji Hocchi, Tokyo (JP)

(73) Assignee: Hakusan Corporation (JP)

( * ) Notice: Subject to any disclaimer, the term of this patent is extended or adjusted under 35 U.S.C. 154(b) by 30 days.

(21) Appl. No.: 09/918,609

(22) Filed: Jul. 31, 2001

(65) Prior Publication Data

US 2002/0022552 A1 Feb. 21, 2002

(30) Foreign Application Priority Data

Aug. 11, 2000 (JP) ..... 2000-245035

(51) Int. Cl.[7] ..... A63B 9/00; A63B 17/00

(52) U.S. Cl. ..... 482/35; 482/36; 482/37; 482/39

(58) Field of Search ..... 482/35–39, 148, 482/69; 434/55–59, 247; 472/95, 103–118, 135, 136, 77

(56) References Cited

U.S. PATENT DOCUMENTS

| | | | | |
|---|---|---|---|---|
| 5,092,587 A | * | 3/1992 | Ulner et al. | 272/112 |
| 5,125,877 A | | 6/1992 | Brewer | |
| 5,177,926 A | * | 1/1993 | Frankel | 52/665.1 |
| 5,254,058 A | | 10/1993 | Savigny | |
| 5,256,116 A | | 10/1993 | Robinson | |
| 5,326,337 A | * | 7/1994 | Pardella | 482/36 |
| 5,549,195 A | | 8/1996 | Aulagner et al. | |
| 5,690,584 A | * | 11/1997 | Strawcutter et al. | 482/35 |
| 5,692,993 A | * | 12/1997 | Dunn | 482/35 |
| 5,732,954 A | * | 3/1998 | Strickler et al. | 273/441 |
| 5,919,117 A | | 7/1999 | Thompson et al.. | |
| 6,095,952 A | * | 8/2000 | Ali et al. | 482/54 |
| 6,390,952 B1 | * | 5/2002 | Wilson | 482/37 |
| 6,475,117 B1 | * | 11/2002 | Berglund et al. | 482/35 |

FOREIGN PATENT DOCUMENTS

| | | |
|---|---|---|
| DE | 89 08 570.1 | 8/1989 |
| DE | 39 04722 A1 | 8/1990 |
| EP | 0 384 439 A1 | 8/1990 |
| EP | 0 433 195 A1 | 6/1991 |
| FR | 2 613 945 | 10/1988 |
| JP | 08-340619 | 6/1998 |
| JP | 10-163111 | 12/1999 |

* cited by examiner

*Primary Examiner*—Nicholas D. Lucchesi
*Assistant Examiner*—Lori Baker Amerson
(74) *Attorney, Agent, or Firm*—TraskBritt

(57) ABSTRACT

Prior art movable types of artificial walls are incapable of offering attractive climbing on irregular wall surfaces, and in the case of a prior art artificial wall having an irregular shape formed on its wall surface, it is difficult to immediately change the irregular shape, and in addition, it is impossible to change the irregular shape while an athletic competition is in progress. A movable artificial wall according to the present invention includes multiple plates each made of a plate of polygonal shape and connected to one another by connection means each of which provides pivotal connection between the sides of the multiple plates, and is characterized in that the whole of each of at least two sides of one of the multiple plates is connected to the whole of one side of another of the multiple plates and the multiple plates are connected to one another so that the multiple plates are closely adjacently arranged about at least one vertex of at least one of the multiple plates.

10 Claims, 8 Drawing Sheets

MOVABLE ARTIFICIAL WALL AND FREE-CLIMBING APPARATUS

BACKGROUND OF THE INVENTION

1. Technical Field of the Invention

The present invention relates to a movable artificial wall to be used for training for rock climbing or the like (hereinafter referred to simply also as "artificial wall"), and also relates to a free-climbing apparatus which has irregular-shape members on its wall surface and can be easily and freely changed in the shape of the wall surface.

2. Description of the Prior Art

Styles frequently used during free climbing which is climbing on a natural wall or an artificial wall for the purpose of athletic competition or sports are divided into artificial climbing and free climbing. In artificial climbing (also called aid climbing or artificial climbing), users positively utilize auxiliary tools such as stirrups, bolts, pitons, nuts, skyhooks(cliff-climbing) or ropes, whereas in free climbing, users merely use such tools as ropes for the purpose of avoiding dangers such as falls, and perform climbing on walls by means of the physical capabilities of human beings.

Artificial walls which are used for the free climbing are also called "climbing artificial structures" or "climbing walls". The basic structure of such an artificial wall is such that holds which serve as handholds or footholds during the climbing are arranged on a concrete wall surface, and the wall surface is straight over its entire height and the holds in many cases are members which are randomly arranged and secured to the wall surface.

To make the artificial wall climbing far more interesting, attempts have been made to change the arrangement of members used as the holds or to employ various members as the holds. In recent years, it has been proposed to use a movable type of the artificial wall or an artificial wall having a wall surface on which an irregular shape is formed.

Japanese Patent Laid-open No. 347170/1999-A proposes a free-climbing artificial wall which can be installed even in a narrow place such as an indoor place. The free-climbing artificial wall is constructed in such a manner that an endless shutter having plural holds rigidly secured to its surface is rotatably supported at the top and bottom ends of a frame and the shutter can be rotated by driving means so that the surface moves downward, and the surface of the shutter constitutes a wall portion for the free climbing. The free-climbing artificial wall is provided with angle adjusting means for adjusting the inclination angle of the frame, and is constructed to enable the angle of the frame to be adjusted by the angle adjusting means during the rotation of the shutter.

Similarly, artificial walls provided with structures for rotating endless shutters are disclosed in U.S. Pat. Nos. 5,919,117, 5,549,195 and 5,125,877. The art disposed in U.S. Pat. No. 5,256,116 enables a user to use plural wall surfaces by rotating an apparatus provided with the plural wall surfaces, and U.S. Pat. No. 5,256,116 proposes an example which uses a hexagonal prism having six faces usable as climbing wall surfaces, respectively, and enables the hexagonal prism to rotate about the axis thereof so that the plural wall surfaces can be used.

Further, Japanese Patent Laid-open No. 155961/1998-A proposes a free-climbing artificial wall having rock surfaces which are similar in shape and texture to actual rock surfaces. A plane panel of predetermined shape and curved panels having plural kinds of curved patterns are combined with one another and are closely adjacently fitted to a panel support metal of a skeleton structure which is built in advance, thereby constituting the climbing wall surface which covers the periphery of the skeleton structure. An artificial wall having similar irregularities is also proposed in U.S. Pat. No. 5,254,058.

There has been another type of movable artificial wall capable of changing the shape of its wall surface. This movable artificial wall is provided with plural square or rectangular plates and each of the plates is connected in series with others in a side-to-side fashion, and the inclination of the artificial wall can be changed at intermediate portions thereof.

Incidentally, in the present invention, the term "irregularity(unevenness)" or "irregular(uneven) shape" encompasses not only the formation of valley-like elongate recesses and ridge-like horizontal projections, but also the formation of recesses depressed from the surrounding and ridge-like shapes projecting from the surrounding. Accordingly, in the present invention, an elongate recess and a recess depressed from the surrounding are referred to simply as "recess" or "recess portion", and a horizontal projection and a ridge portion projecting from the surrounding are referred to simply as "projection" or "projection portion".

Since there has not heretofore been an artificial wall of a movable type which has an irregular surface shape, good results have not yet been achieved in climbing exercises or training with a high degree of freedom. Specifically, in prior art movable types of the artificial walls, climbing walls are nearly flat straight walls, and changing a wall surface is restricted to changing the entire angle of a climbing surface. Since the wall surface is fixed and unattractive, there is the disadvantage that if the users repeatedly use such a prior art artificial wall, they will lose interest.

Although the degree of difficulty can be changed by changing the positions of the holds, the range of variations of training is extremely restricted. In the case of the artificial wall having an irregular shape formed on its wall surface, a user can have the feeling of climbing on an actual rock surface, but needs to perform time-consuming procedures to change the shape of an irregularity or the positions of the holds.

Accordingly, it is difficult to immediately change the irregular shape in an athletic competition, and it is impossible to change the irregular shape while an athletic competition is in progress. In addition, in the case of a movable type of the artificial wall provided with plural plates, it is possible to change the inclination of the artificial wall, but it is impossible to form an irregular shape on the wall surface of the artificial wall.

SUMMARY OF THE INVENTION

The present invention has been made in view of the above described problems, and an object of the present invention is to provide a free-climbing apparatus having an artificial wall which has a far more interesting irregular wall surface. and which can be easily and freely changed in the shape of the wall surface.

In accordance with the present invention, there is provided a movable artificial wall which includes multiple plates each made of a plate of polygonal shape and connected to one another by connection means each of which provides pivotal connection between the sides of the multiple plates, the whole of each of at least two sides of one of the multiple plates being connected to the whole of one side of another of the multiple plates, the multiple plates being connected to one another so that the multiple plates are closely adjacently arranged about at least one vertex of at least one of the multiple plates. Preferably, the multiple plates are triangles.

In accordance with the present invention, there is provided a movable artificial wall which further includes driving means for turning the multiple plates about the connection means.

In accordance with the present invention, there is provided a free-climbing apparatus which includes the movable artificial wall, measurement means for measuring a relative position between the multiple plates, and a control device capable of communicating data with the measuring means and transmitting instructions as to driving and driving speeds to the respective driving means, the control device having a database which stores data as to deformation patterns for changing the shape of a wall portion of the artificial wall, and a function which controls the driving and the driving speed of the driving means on the basis of data stored in the database.

In accordance with the present invention, there is provided a free-climbing apparatus wherein the control device has a display capable of displaying a three-dimensional image of the wall portion, and a function which simulates deformation of the wall portion when a desired deformable portion of the wall portion displayed on the display is dragged by a pointing device such as a mouse, and subsequently controls the driving and the driving speed of the driving means on the basis of simulation data.

Further, in accordance with the present invention, there is provided a free-climbing apparatus which further includes model plates having similar shapes to the respective multiple plates, model measuring means for measuring relative positions of the model plates, and a model of the wall portion which can be changed into a shape similar to the wall portion, the control device being capable of receiving data from the model measuring means, and having a function which controls the driving and the driving speed of the driving means on the basis of data measured by the model measuring means.

Still further, in accordance with the present invention, there is provided a free-climbing apparatus which further includes wires for suspending the wall portion at least three points on the opposite surface to its climbing wall surface, support pillars for supporting the wires, and winches for changing an inclination of the climbing wall surface by changing the lengths of the wires. The free-climbing apparatus preferably further includes wire length measuring means for measuring the inclination of the climbing wall surface by measuring the lengths of the wires, the control device being capable of receiving data from the wire length measuring means and transmitting instructions as to driving and driving speeds to the respective winches, and having a function capable of displaying on the display the inclination of the wall portion based on the received data, and capable of accepting an entry of an arbitrary inclination and giving the respective winches instructions as to driving and driving speeds.

DESCRIPTION OF THE PREFERRED EMBODIMENTS

Embodiments of a free-climbing apparatus according to the present invention will be described below with reference to the accompanying drawings.

Figure 1:
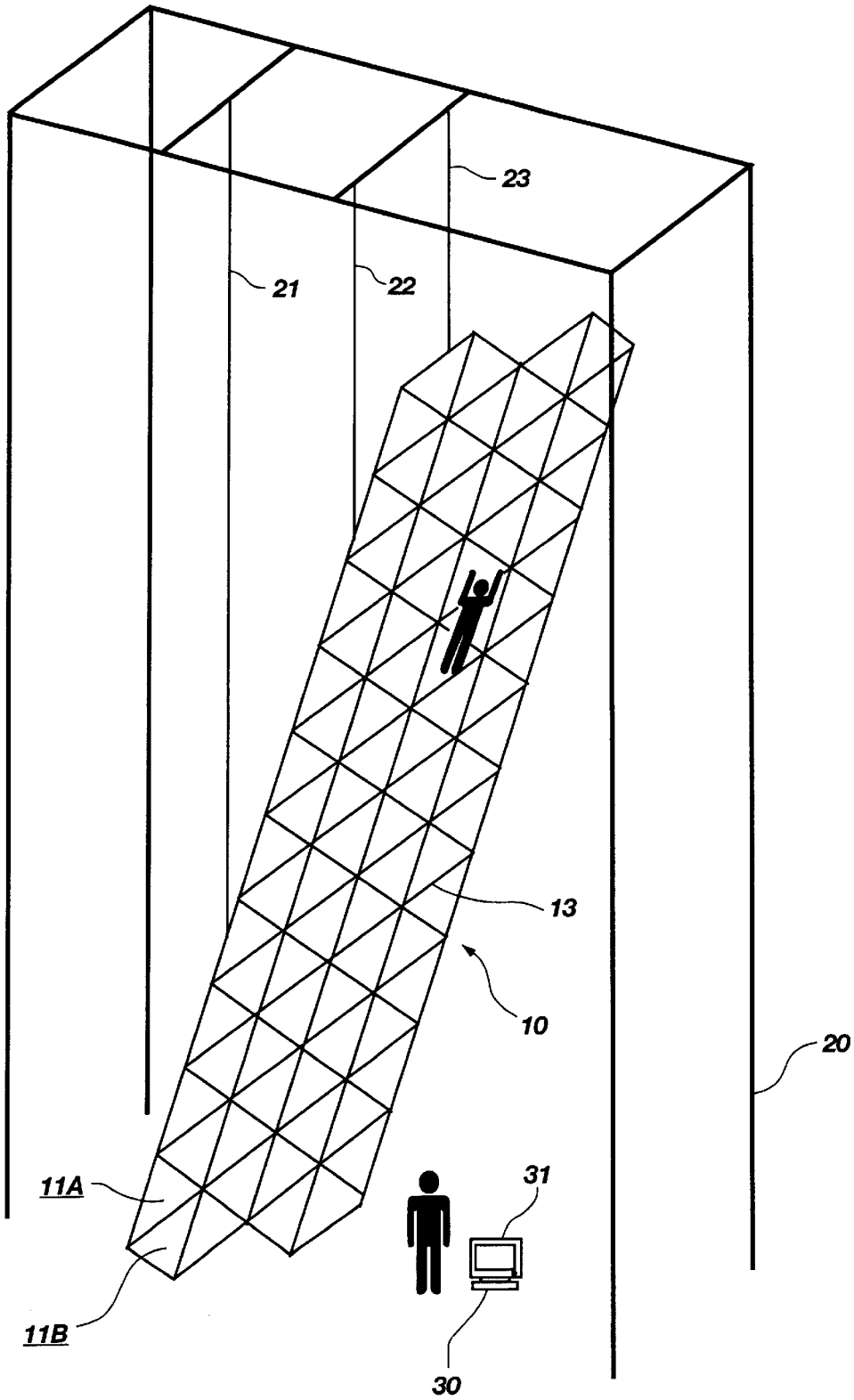
FIG. 1 is a schematic view showing the entire construction of one example of a free-climbing apparatus according to the present invention.

FIG. 1 is a schematic perspective view of an artificial wall viewed from the front side thereof, and schematically shows the entire construction of one example of a free-climbing apparatus according to the present invention. Plural plates 11A (shown in white) and 11B (shown in black or gray), each of which has the form of a regular triangle, are joined in a side-to-side fashion to form an artificial wall 10 which enables its projections and recesses to be changed. In this example, the artificial wall 10 is constructed in such a manner that twenty-one plates are joined together in the height direction with four plates joined together in the width direction. The bottom of the artificial wall 10 is installed on the ground and intermediate portions of the artificial wall 10 are suspended by wires 21 to 23 which are hung from the ceiling portion of the post assembly 20, whereby the artificial wall 10 is retained unmovably.

The free-climbing apparatus is equipped with a control device 30 which has an operating part for driving the plates 11A and 11B to change the shape of the irregular surface, and a display 31 for simulating and displaying the shape of the irregular surface. Incidentally, the control device 30 and the display 31 may also be made of a personal computer, and many holds may be removably(mounting and removal) screwed into the front surfaces of the plates 11A and 11B by means of screw structures, or may be removably fitted to the front surfaces by bolts and nuts. Otherwise, the holds may be fixed to the front surfaces by adhesive.

Figure 2:
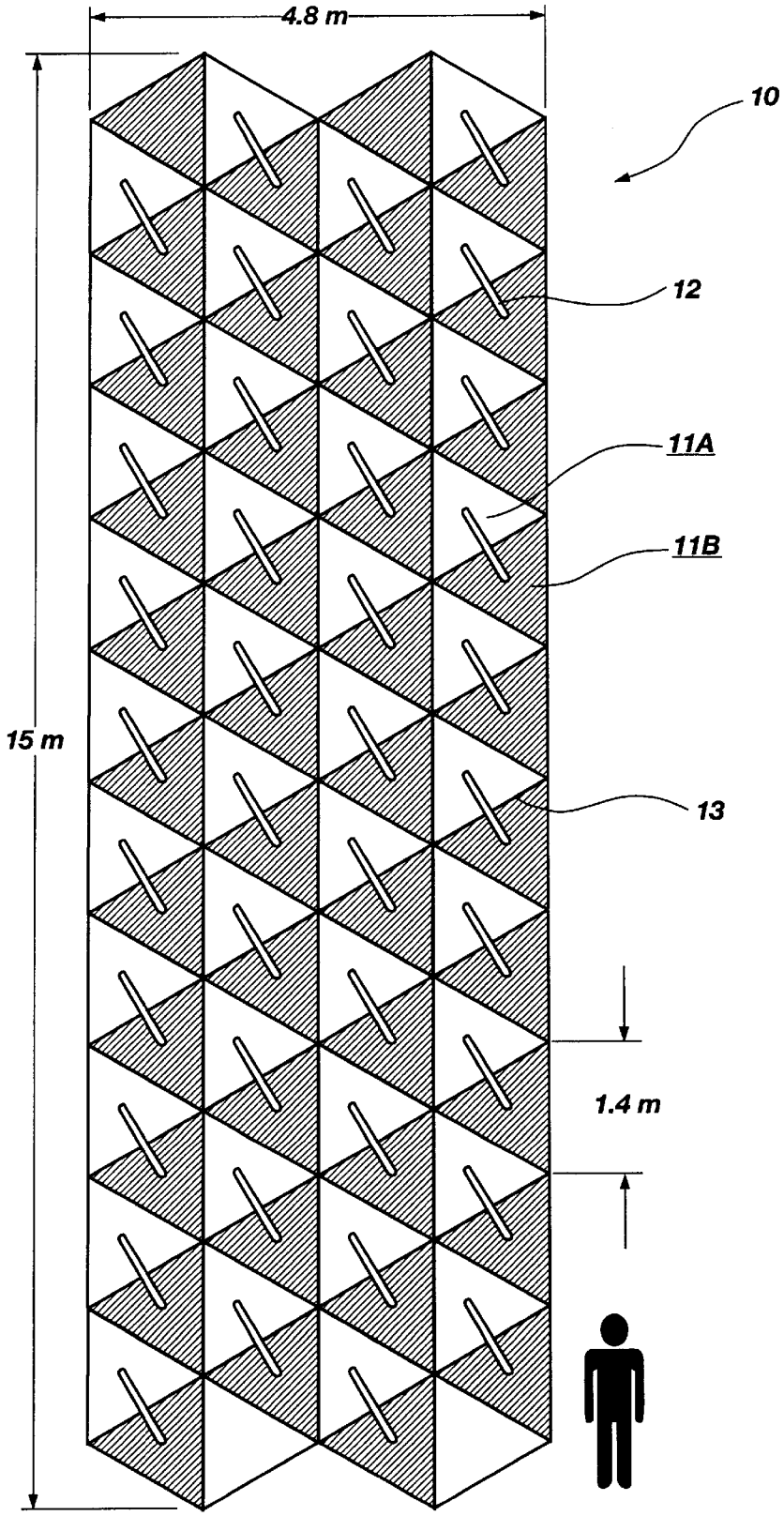
FIG. 2 is a view of the back structure of one example of an artificial wall according to the present invention.

FIG. 2 shows the back structure of one example of the artificial wall 10 according to the present invention. In FIG. 2, each of the plates 11A and 11B has the form of a regular triangle with sides of length 1.4 m, and the artificial wall 10 has a height of 15 m and a width of 4.8 m. Rod-shaped driving members 12 for forcing the corresponding plates 11B upwardly to change the irregular surface are pivotally supported on the surfaces of the backs of the plates 11B. The shown artificial wall 10 includes the plates 11A and 11B each having the form of a regular triangle with sides of length 1.4 m, and the plates 11A and 11B are arranged closely adjacent to one another in the form of a plane. Each of the plates 11A and 11B is connected to all of the adjacent plates by hinges 13 for pivotal motion about each of its sides.

In the present invention, the entire length of one of the sides of each of the plates 11A is hereinafter called the "whole of one of the sides", and the whole of one of the sides of each of the plates 11A is in contact with the whole of one of the sides of an adjacent one of the plates 11B. In addition, each of the plates 11A is connected to an adjacent one of the plates 11B by one of the driving members 12, and FIG. 2 shows a case in which all the driving members 12 are disposed in parallel with one another. When one of the driving members 12 receives an instruction from the control device 30, the other driving members make movements in interlocking relationship with the one of the driving members 12. One white plate and one black(gray) plate which are connected to each other by one of the driving members 12 is hereinafter called "a set of plates".

In this example, although each of the plates 11A and 11B is shown to have the form of a regular triangle, the form of each of the plates 11A and 11B is not limited to a regular triangle, and it is possible to adopt plates of any form as long as the whole of each of at least two sides of one plate can be connected to the whole of one side of another plate and the plates can be connected to one another so that multiple plates are arranged closely adjacently to one another about at least one vertex of at least one polygonal plate. For example, the plates may also have the form of a triangle(a regular triangle, an isosceles triangle, a rectangular triangle, a rectangular isosceles triangle or any triangle other than the regular triangle, the isosceles triangle, the rectangular triangle and the rectangular isosceles triangle) or a polygon having four or more sides(a square, a rectangle, a rhombus or any polygon other than the square, the rectangle and the rhombus, such as a quadrangle, a pentagon, a hexagon, a heptagon, an octagon, a nonagon or a decagon). In addition, an artificial wall in which such polygonal plates are combined to be arranged closely adjacently to one another may has a side edge which is not rectilinear but curvilinear.

In addition, even in the case of the plates having the form of a triangle(a regular triangle, an isosceles triangle, a rectangular triangle, a rectangular isosceles triangle or any triangle other than the regular triangle, the isosceles triangle, the rectangular triangle and the rectangular isosceles triangle) or a polygon having four or more sides(a square, a rectangle, a rhombus or any polygon other than the square, the rectangle and the rhombus, such as a quadrangle, a pentagon, a hexagon, a heptagon, an octagon, a nonagon or a decagon), or even in the case of plates having curves, it is possible to form a movable artificial wall as long as such a plate has a rectilinear portion along its side edge and has connecting means which connects the plate to another plate in contact therewith in a side-to-side fashion so that the plate can pivot about the rectilinear portion.

A first embodiment of the hinges 13 and the driving members 12 which connect the plates 11A and 11B together will be described below in detail with reference to FIGS. 3A to 3C.

Figure 3A:
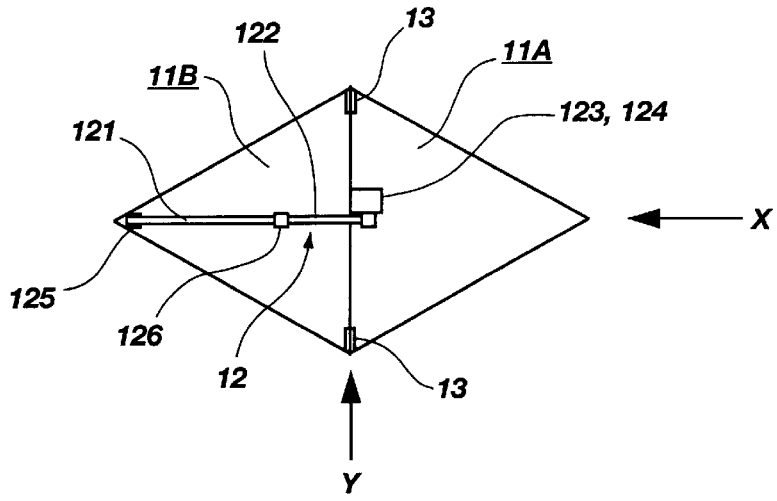
FIGS. 3A to 3C are views showing a first embodiment of a set of plate of the artificial wall according to the present invention.

FIG. 3A is a view of the back of a set of plates which form a plane portion in the artificial wall 10. The backs of the set of plates are pivotally connected together by two hinges 13 which are respectively disposed at opposite extreme ends between the connected sides of the plates 11A and 11B, and are further pivotally supported by one rod-shaped driving member 12 which is disposed to be perpendicular to the sides of the plates 11A and 11B pivotally connected by the hinges 13. The driving member 12 is made of a reduction motor 123 and rod-shaped rods 121 and 122, and the reduction motor 123 is secured to the plate 11A. The rod 122 is turnably connected at one end to the reduction motor 123 and is turnably connected at the other end to the rod 121 by a rotating pivot point 126, while the end of the rod 121 that is not connected to the rod 122 is rotatably secured to the plate 11B at a pivot point 125.

The rods 121 and 122 are formed in the shape of a mountain with respect to the plates 11A and 11B. The reduction motor 123 may be secured to either of the plates 11A or 11B, and if the reduction motor 123 is secured to the plate 11B, the rod 121 is turnably secured to the plate 11A. The hinges 13 are not limited in arrangement or number as long as the set of plates can be pivotally secured, and the hinges 13 need not necessarily be arranged at the opposite extreme ends between the connected sides of the plates 11A and 11B and the number of the hinges 13 may not be two.

Further, the reduction motor 123 is provided with measuring means 124 capable of measuring the angle formed by the plates 11A and 11B by measuring the angle of rotation of the rod 122, and the measuring means 124 uses a potentiometer or an encoder.

Figure 3B:
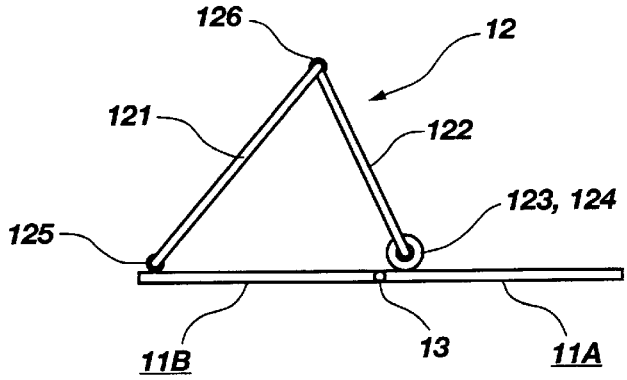
Figure 3C:
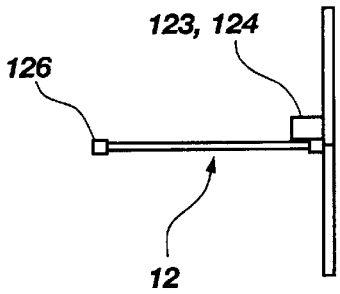

FIG. 3B is a side view of the set of plates viewed in the direction indicated by an arrow Y in FIG. 3A, and FIG. 3C is a side view of the set of plates viewed in the direction indicated by an arrow X in FIG. 3A. The rods 121 and 122 are arranged in the form of a mountain in a direction perpendicular to the plates 11A and 11B.

Next, the operation of the set of plates according to the first embodiment will be described below with reference to FIGS. 4A and 4B.

Figure 4A:
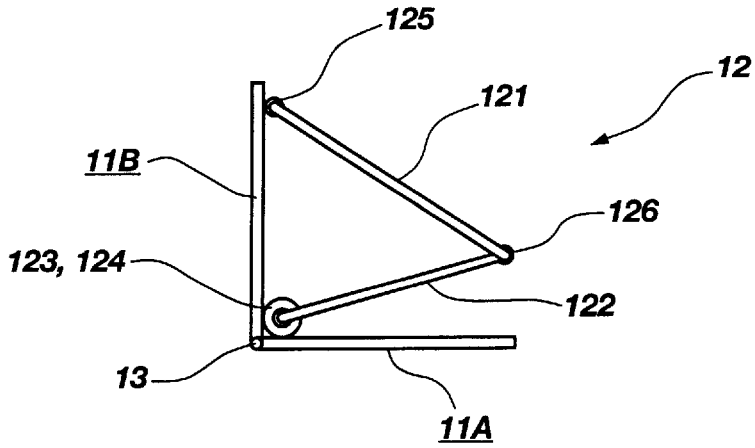
FIGS. 4A and 4B are views showing a method of driving the plates in the first embodiment.

FIG. 4A is a view of the state in which a ridge-like horizontal projection is formed on the artificial wall 10 by the set of plates. As the reduction motor 123 turns the rod 122 to the right from the state shown in FIG. 3B about the axis of the rotating shaft of the reduction motor 123, the rod 121 interlockingly moves and lifts up the plate 11B, thereby forming the horizontal projection shown in FIG. 4A. FIG. 4A shows the largest horizontal projection formed by the set of plates, i.e., a horizontal projection of 90 degrees.

Figure 4B:
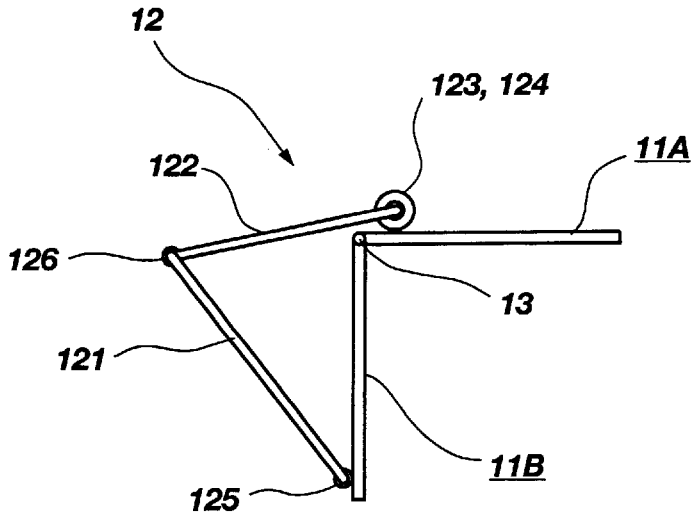

FIG. 4B is a view of the state in which a valley-like elongate recess is formed on the artificial wall 10 by the set of plates. As the reduction motor 123 turns the rod 122 to the left from the state shown in FIG. 3B about the axis of the rotating shaft of the reduction motor 123, the rod 121 interlockingly moves and forces down the plate 11B, thereby forming the elongate recess shown in FIG. 4B. FIG. 4B shows the deepest elongate recess formed by the set of plates, i.e., a recess of 90 degrees.

The angle formed by the plates 11A and 11B can continuously take all angles between the case where the largest horizontal projection is formed and the case where the deepest elongate recess is formed, and such angle can be measured by the measuring means 124.

In this manner, the set of plates forms the horizontal projection or the elongate recess, while other sets of plates interlockingly form other horizontal projections or elongate recesses, whereby the irregular shape can be formed by the vertex portions of the plates and an irregular shape is formed on the artificial wall 10.

The hinges 13 and the driving members 12 which connect the plates 11A and 11B together according to a second embodiment will be described below with reference to FIGS. 5A to 5C.

Figure 5A:
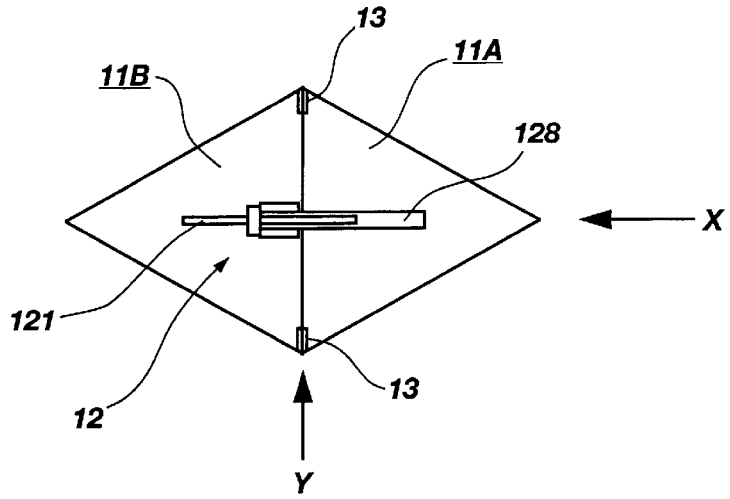
FIGS. 5A to 5C are views showing a second embodiment of the set of plates of the artificial wall according to the present invention.

FIG. 5A is a view of the back of a set of plates which form a plane portion in the artificial wall 10. One driving member 12 is pivotally supported on the backs of the set of plates. The driving member 12 is made of the reduction motor 123, a pinion gear 127 to be driven by the reduction motor 123, a motor securing member 128 which secures the reduction motor 123 to the top of the plate 11A, and a curve-shaped meshing member 129 which has a toothed irregular portion in its upper portion and is engaged with the teeth of the pinion gear 127. The motor securing member 128 is secured to the plate 11A, and also secures the reduction motor 123. The pinion gear 127 is pivotally supported by the motor securing member 128, and the lower ones of the teeth of the pinion gear 127 mesh with the toothed irregular portion of the meshing member 129.

The meshing member 129 is secured to the plate 11B, and the plate 11B is rotated about one side thereof which is connected to a contact side of the plate 11A, by the rotation of the pinion gear 127. The motor securing member 128 may be secured to either of the plates 11A or 11B, and if the motor securing member 128 is secured to the plate 11B, the meshing member 129 is secured to the plate 11A. The motor securing member 128 may also have a recess for insertion of the reduction motor 123 so that the reduction motor 12 can be inserted into the recess when the meshing member 129 is moved toward the right by the rotation of the pinion gear 127.

Figure 5B:
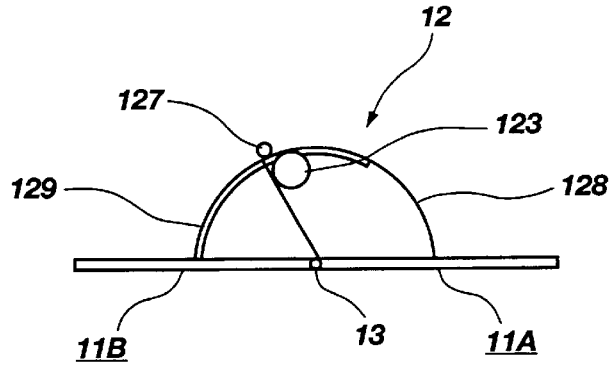
Figure 5C:
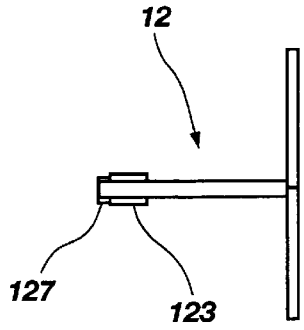

FIG. 5B is a side view of the set of plates viewed in the direction indicated by an arrow Y in FIG. 5A. The motor securing member 128 and the meshing member 129 are arranged in the form of a fan centered about the connected sides of the plates 11A and 11B, and are also arranged in a direction perpendicular to the plates 11A and 11B. FIG. 5C is a side view of the set of plates viewed in the direction indicated by an arrow X in FIG. 5A.

The operation of the set of plates according to the second embodiment will be described below with reference to FIGS. 6A and 6B.

Figure 6A:
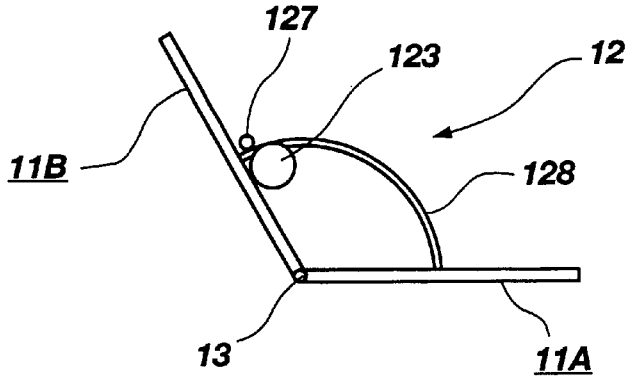
FIGS. 6A and 6B are views showing a method of driving the plates in the second embodiment.

FIG. 6A is a view of the state in which a ridge-like horizontal projection is formed on the artificial wall 10 by the set of plates. As the reduction motor 123 rotates the pinion gear 127 to the left from the state shown in FIG. 5B, the meshing member 129 moves to the right and lifts up the plate 11B, thereby forming the horizontal projection shown in FIG. 6A. FIG. 6A shows the largest horizontal projection formed by the set of plates, i.e., a horizontal projection of 120 degrees.

Figure 6B:
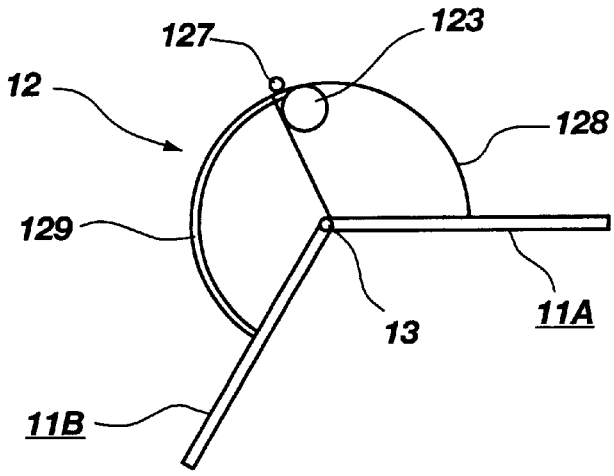

FIG. 6B is a view of the state in which a valley-like elongate recess is formed on the artificial wall 10 by the set of plates. As the reduction motor 123 rotates the pinion gear 127 to the right from the state shown in FIG. 5B, the meshing member 129 moves to the left and lift down the plate 11B, thereby forming the horizontal projection shown in FIG. 6B. FIG. 6B shows the deepest elongate recess formed by the set of plates, i.e., a recess of 120 degrees.

The angle formed by the plates 11A and 11B can continuously take all angles between the case where the largest horizontal projection is formed and the case where the deepest elongate recess is formed, and such angle can be measured by the measuring means 124.

In this manner, the set of plates forms the horizontal projection or the elongate recess, while other sets of plates interlockingly form other horizontal projections or elongate recesses, whereby the irregular shape can be formed by the vertex portions of the plates and an irregular shape is formed on the artificial wall 10.

The control device 30 and the display 31 shown in FIG. 1 will be described below in detail.

Control of the deformation or change of the artificial wall 10 is executed by the control device 30, and the control device 30 can communicate data with the measuring means 124 and can also transmit instructions as to driving and driving speeds to the reduction motor 123. The control device 30 has the function of a database of deformation patterns for the artificial wall 10, and can select predetermined data to select a desired shape and control the driving speed at which the artificial wall 10 is to be deformed into the desired shape. The control device 30 performs the following operation:

(1) The control device 30 receives data indicative of the angles formed by the plates 11A and 11B, which are measured by the measuring means 124, and (2) calculates the rotation directions and the rotation amounts of all the plates per unit time, which are required to approximate a desired shape, and transmits the resultant instructions to all the reduction motors 123. (3) The reduction motors 123 which have received the instructions execute deformation according to the rotation directions and the rotation amounts indicated by the instructions, and then the measuring means 124 measure the relative rotation angles of the respective sets of plates and transmit the measured values to the control device 30. (4) The control device 30 calculates the shape of the entire solid surface of the artificial wall 10 from information indicative of the relative rotation angles of the respective sets of plates which have been transmitted from the respective measuring means 124, and also calculates the rotation directions and the rotation amounts of all the plates per unit time, which are required to approximate the desired shape, and transmits the resultant instructions to all the reduction motors 123. After that, the above operations (3) and (4) are repeated until the artificial wall 10 reaches a final shape to be desired.

In addition, the control device 30 is capable of displaying the shape of the artificial wall 10 on the display 31 on the basis of data received from the measuring means 124 or data stored in the database, and has a simulation function which enables confirmation of a feasible solid surface of the artificial wall 10 before the artificial wall 10 is actually deformed. If an operator drags a desired deformable portion of a wall of 3-D graphics displayed on the display 31, the control device 30 calculates deformation and graphically displays the calculated deformation. Moreover, the control device 30 stores the calculated deformation in the form of data so that the deformation of the artificial wall 10 can be controlled.

Although not shown, the model of the artificial wall 10 that is made of model plates having similar shapes to the plates(plates 11A and 11B) and can be changed in shape similarly to the artificial wall 10 may also be prepared so that it is possible to simulate deformation of the solid surface of the artificial wall 10. Similarly to the measuring means 124, the model measuring means is capable of performing the model measurements to obtain data as to the relative positions of the sets of model plates, and the model measuring means uses a potentiometer. The control device 30 can receive data as to deformation from the model measuring means, and can use the received data as data indicative of a deformation pattern for the artificial wall 10.

Figure 7:
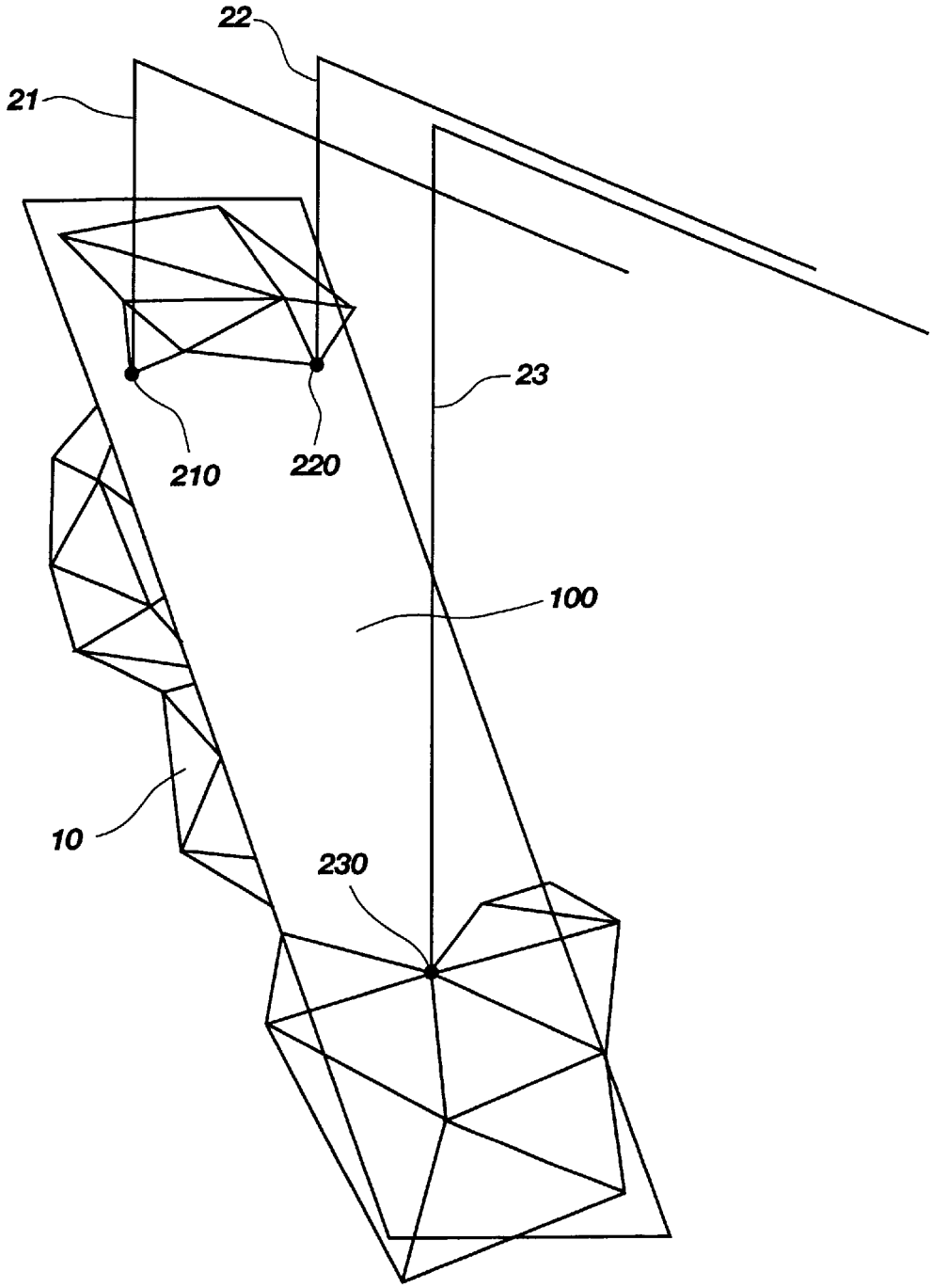
FIG. 7 is a view of one example of means for changing the inclination of a free-climbing apparatus according to the present invention.

FIG. 7 is a perspective view of the artificial wall 10 viewed from the back, and shows one example of means for changing the inclination of a free-climbing apparatus according to the present invention. The bottom of the artificial wall 10 is installed on the ground and intermediate portions of the artificial wall 10 are suspended by the wires 21 to 23 which are hung from the ceiling portion of the post assembly 20, whereby the artificial wall 10 is retained unmovably. The wires 21, 22 and 23 support the artificial wall 10 on the back surface thereof at three different wall support points 210, 220 and 230, and the vertical and horizontal inclinations of an imaginary(virtual) plane 100 constituted by the three support points 210, 220 and 230 can be changed by changing the distance of each of the wires 21, 22 and 23 from the corresponding one of the wall support points 210, 220 and 230 to the post assembly 20.

In addition, winches for changing the distances of the respective wires(hereinafter referred to as "the wire distance (s)") and wire distance measuring means(not shown) for measuring the wire distances are disposed, and the wire distance measuring means is capable of transmitting data to the control device 30, while the winches have the function of receiving instructions as to driving and driving speeds from the control device 30. In operation, when the driven lengths of the respective wires 21, 22 and 23 are measured by the wire distance measuring means and the measured data are transmitted to the control device 30, the control device 30 calculates the wire distances and displays on the display 31 the inclination of the imaginary plane 100 based on the data.

If an operator enters an arbitrary inclination and gives instructions as to the driving of the winches and the driving speeds thereof, the control device 30 calculates the length and the inclination speed of each of the wires 21, 22 and 23 that are required to incline the artificial wall 10 to the desired extent, and transmits instructions as to the calculated lengths and the inclination speeds to all the winches. After that, the winches change the respective wire distances on the basis of the instructions. Thus, the inclination of the artificial wall 10 can be continuously changed.

Figure 8:
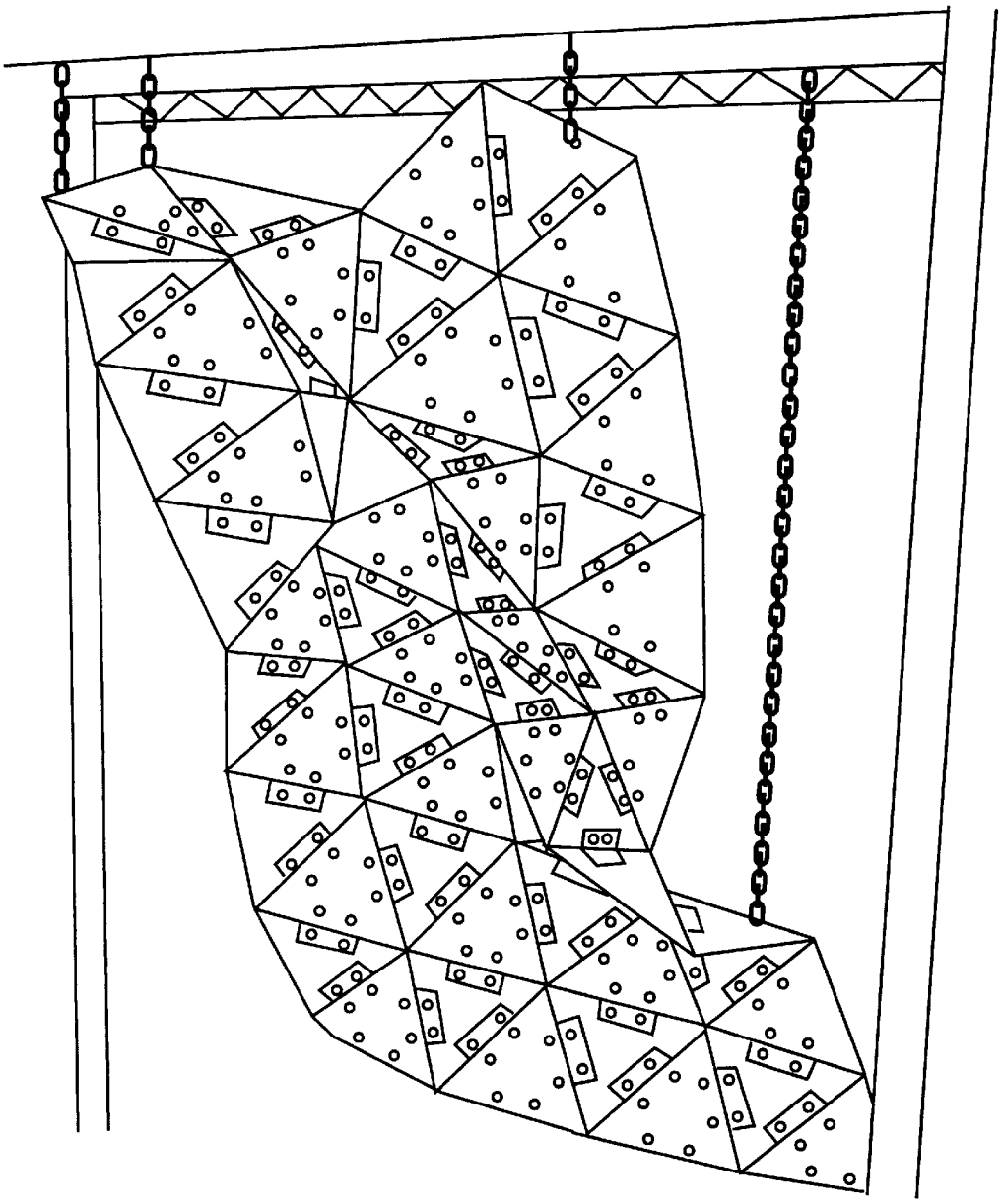
FIG. 8 is a photograph of an embodiment in which an irregular shape is formed on an artificial wall according to the present invention.

FIG. 8 is a photograph of an embodiment in which an irregular shape is formed on an artificial wall according to the present invention, and shows the artificial wall 10 viewed from the front. The bottom of the artificial wall 10 is installed on the ground and intermediate portions of the artificial wall 10 are suspended by plural wires which are hung from the ceiling portion of the post assembly 20, whereby the artificial wall 10 is retained unmovably.

Since the artificial wall 10 according to the present invention has a module structure, it is possible to freely enlarge or reduce the artificial wall 10 in either of the height and width directions by fitting or removing plates to or from the artificial wall 10.

Incidentally, an artificial wall which has a height of about 15 m and a width of about 5 m to satisfy the specifications of an artificial wall for athletic competition adopted at the National Athletic Meet in Japan is formed by an artificial wall in which triangular plates with sides of length 1.4 m, such as those shown in FIG. 2, are combined in such a manner that twenty-one plates are arranged in the height direction with four columns arranged in the width direction.

A movable artificial wall according to the present invention is a movable artificial wall which has multiple plates and can change the relative positions between the multiple plates to form local irregular shapes similar to actual rock surfaces on the wall surface of the artificial wall. Accordingly, the movable artificial wall has the advantage that since the irregular shapes can be easily changed, the degree of difficulty in climbing can be continuously changed and it is possible to provide climbing walls which resemble actual rock surfaces rich in variation, as well as the advantage that since the plates have a module structure and can be easily removed, the artificial wall can be easily moved and changed in size.

A movable artificial wall according to the present invention is a movable artificial wall which includes plural plates and parts which drive the plural plates. This movable artificial wall has the advantage that it is far easier to change an irregular shape and it is also possible to provide a novel interesting feature which requires a user to keep dynamic balance because the irregular shape changes during climbing.

Moreover, in a free-climbing apparatus according to the present invention, since the movable artificial wall and a computer capable of providing control can perform mutual data exchange, there is the advantage that an irregular shape can be easily changed and the operation of deforming an irregular shape once can be easily reproduced.

Moreover, a free-climbing apparatus according to the present invention includes models or a computer in addition to plural plates and means for driving the plural plates, and has the advantage that it is possible to create control data as to arbitrary changes in irregular shapes in spite of easy entry of control data, by combining the models with the plates and the means or by dragging and deforming a computer's three-dimensional graphics image.

Moreover, a free-climbing apparatus according to the present invention has the advantage that it is possible to form an artificial wall of far more desired shape by changing the inclination of the artificial wall in addition to the irregular shape.

What is claimed is:

1. A movable artificial wall made of multiple plates each made of a plate of polygonal shape and connected to one another by connection means each of which provides pivotal connection between sides of the multiple plates, characterized in that the whole of each of at least two sides of one of the multiple plates is connected to the whole of one side of another of the multiple plates, and the multiple plates are connected to one another so that the multiple plates are closely adjacently arranged about at least one vertex of at least one of the multiple plates.

2. A movable artificial wall according to claim 1, characterized in that the multiple plates are triangles.

3. A movable artificial wall according to claim 1, including driving means for turning the multiple plates about the connection means.

4. A movable artificial wall according to claim 2, including driving means for turning the multiple plates about the connection means.

5. A free-climbing apparatus including:

the movable artificial wall; measurement means for measuring a relative position between the multiple plates; and a control device capable of communicating data with the measuring means and transmitting instructions as to driving and driving speeds to the respective driving means, characterized in that the control device has a database which stores data as to deformation patterns for changing the shape of the wall portion, and a function which controls the driving and the driving speed of the driving means on the basis of data stored in the database.

6. A free-climbing apparatus according to claim 5, wherein the control device has a display capable of displaying a three-dimensional image of the wall portion, and a function which simulates deformation of the wall portion when a desired deformable portion of the wall portion displayed on the display is dragged by a pointing device such as a mouse, and subsequently controls the driving and the driving speed of the driving means on the basis of simulation data.

7. A free-climbing apparatus according to claim 5, further including model plates having similar shapes to the respective multiple plates, model measuring means for measuring relative positions of the model plates, and a model of the wall portion which can be changed into a shape similar to the wall portion, the control device being capable of receiving data from the model measuring means and having a function which controls the driving and the driving speed of the driving means on the basis of data measured by the model measuring means.

8. A free-climbing apparatus according to claim 5, further including wires for suspending the wall portion at least three points on the opposite surface to its climbing wall surface, support pillars for supporting the wires, and winches for changing an inclination of the climbing wall surface by changing the lengths of the wires.

9. A free-climbing apparatus according to claim 6, further including wires for suspending the wall portion at least three points on the opposite surface to its climbing wall surface, support pillars for supporting the wires, and winches for changing an inclination of the climbing wall surface by changing the lengths of the wires.

10. A free-climbing apparatus according to claim 8, further including wire length measuring means for measuring the inclination of the climbing wall surface by measuring the lengths of the wires, the control device being capable of receiving data from the wire length measuring means and transmitting instructions as to driving and driving speeds to the respective winches, and having a function capable of displaying on the display the inclination of the wall portion based on the received data, and capable of accepting an entry of an arbitrary inclination and giving the respective winches instructions as to driving and driving speeds.

* * * * *